US006692289B2

(12) United States Patent
Nemoto

(10) Patent No.: US 6,692,289 B2
(45) Date of Patent: Feb. 17, 2004

(54) ELECTRIC CONNECTOR WITH A LOCKING MECHANISM

(75) Inventor: Kazuhiro Nemoto, Tokyo (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 10/353,361

(22) Filed: Jan. 28, 2003

(65) Prior Publication Data

US 2003/0143886 A1 Jul. 31, 2003

(30) Foreign Application Priority Data

Jan. 31, 2002 (JP) ..... 2002-024720

(51) Int. Cl.[7] ..... H01R 13/627
(52) U.S. Cl. ..... 439/352; 439/372; 439/160
(58) Field of Search ..... 439/352, 353, 439/372, 358, 157, 160, 155, 354

(56) References Cited

U.S. PATENT DOCUMENTS 5,011,425 A 4/1991 Van Zanten et al.
5,437,559 A * 8/1995 Okumura et al. ..... 439/310
5,480,324 A * 1/1996 Maegawa et al. ..... 439/489
5,779,495 A * 7/1998 Dechelette et al. ..... 439/353
6,059,597 A * 5/2000 Endo et al. ..... 439/352
6,254,418 B1 * 7/2001 Tharp et al. ..... 439/352
6,315,585 B1 * 11/2001 Oka ..... 439/157
6,450,830 B1 * 9/2002 Koseki ..... 439/352

FOREIGN PATENT DOCUMENTS

JP 2888925 2/1999

* cited by examiner

*Primary Examiner*—Tho D. Ta
*Assistant Examiner*—Edwin A. León
(74) *Attorney, Agent, or Firm*—W. F. Fasse; W. G. Fasse

(57) ABSTRACT

In an electric connector with a locking mechanism, the amount of operation and the operation resistance of the operating parts can be freely set according to the mode of use. The electric connector includes a body to be inserted into a receiving recess of a counterpart electric connector, a flexible arm extending from the body and having a protrusion that fits into a fitting hole of the receiving recess of the counterpart electric connector, a slider provided on the body so that the slider can slide in the direction of insertion and withdrawal, and an operating lever rotatably provided on the arm or the body so that the top end thereof comes out on the rear face side of the body and coupled with the slider so that when the operating lever is rotated, the slider will be slid. The arm and/or the slider has a cam face which is inclined so that its distance from the side wall of the body changes along the direction of insertion and withdrawal and makes the arm flex according to the sliding of the slider so that the protrusion comes closer to the side wall of the body.

8 Claims, 4 Drawing Sheets

ELECTRIC CONNECTOR WITH A LOCKING MECHANISM

BACKGROUND OF THE INVENTION

1. Field of the Invention

The present invention relates to an electric connector with a locking mechanism, which locks the connector body when the body is inserted in a receiving recess of a counterpart connector, by inserting a protrusion provided on a side wall of the body into a fitting hole made in the receiving recess, so as to prevent inadvertent withdrawal of the body.

2. Related Art

Japanese Patent Gazette 2888925 discloses an electric connector with a locking mechanism, wherein the electric connector comprises a body to be inserted into a receiving recess of a counterpart electric connector, and a locking element which extends outside the body in the direction of insertion and withdrawal and contacts with the external wall of the body at a pivot point, and the locking element is provided with protrusions rising in a direction of going away from the side wall of the body at the front end of the locking element in the direction of insertion and withdrawal. When the body of this electric connector with a locking mechanism is inserted into a receiving recess of a counterpart electric connector, the protrusions of the locking element will fit into the fitting holes of the receiving recess of the counterpart electric connector and the electric connector with a locking mechanism will be locked on to the counterpart electric connector. When the electric connector with a locking mechanism is to be withdrawn from the counterpart electric connector, the rear end of the locking element in the direction of insertion and withdrawal is held to shift the locking element towards the body. Then the protrusions of the locking element will come off the fitting holes of the receiving recess of the counterpart electric connector, allowing the withdrawal of the electric connector with a locking mechanism.

In the case of the above-mentioned conventional electric connector with a locking mechanism, when the electric connector with a locking mechanism is to be withdrawn from a counterpart electric connector, the entire locking element is shifted towards the body. Hence the amount of shift of the protrusions which is needed to withdraw the protrusions from the fitting holes is the amount of operation of the locking element. Accordingly, when the dimensional relationships between the protrusions and the fitting holes are set, the amount of operation of the locking element will be set singularly. Moreover, because of its construction, the resistance against the operation required for moving the locking element can not be adjusted. However, as electric connectors with a locking mechanism are used in a variety of modes, it had been keenly desired to achieve free setting of the amount of operation and the operation resistance of the locking element according to a desired mode of use.

SUMMARY OF THE INVENTION

The present invention was made in view of these points, and its objective is to provide an electric connector with a locking mechanism, wherein a portion starting from an operating part up to the protrusion is constituted with a plurality of members, and the amount of operation and the operation resistance of the operating part can be set freely according to the mode of use by changing the configuration, position, etc. of a cam face provided on one of these members.

To accomplish the above-mentioned objective, the electric connector with a locking mechanism according to the present invention comprises a body to be inserted into a receiving recess of a counterpart electric connector, a flexible arm, of which a root end is provided on a side wall of the body, said flexible arm extending outside the body in the direction of insertion and withdrawal and being provided with a protrusion, which rises in a direction of going away from the side wall of the body and fits into a fitting hole of the receiving recess of the counterpart electric connector, a slider being provided in such a way that it extends outside the body in the direction of insertion and withdrawal, overlaps with the arm in the direction of going away from the side wall of the body and can slide over the body in the direction of insertion and withdrawal, and an operating lever being rotatably provided on the arm or the body in such a way that the top end thereof comes out on the rear face side of the body and being coupled with the slider in such a way that when the operating lever is rotated, the slider will be slid, at least either said arm or said slider being provided with a cam face which is inclined in such a way that its distance from the side wall of the body changes along the direction of insertion and withdrawal and makes the arm flex according to the sliding of the slider so that the protrusion comes closer to the side wall of the body.

When the body of this electric connector with a locking mechanism is inserted into the receiving recess of a counterpart electric connector, the protrusion will be fitted into the fitting hole of the receiving recess of the counterpart electric connector due to the flexibility of the arm, and the electric connector with a locking mechanism will be locked onto the counterpart electric connector. When the electric connector with a locking mechanism is to be withdrawn from the counterpart electric connector, the operating lever will be rotated. Then the slider will be slid, and due to a guiding function of the cam face, the arm will be flexed and the protrusion will be brought closer to the side wall of the body and will be withdrawn from the fitting hole of the receiving recess of the counterpart electric connector. Then the electric connector with a locking mechanism can be withdrawn. In that case, the amount of operation and/or the resistance against operation of the operating lever can be set freely by changing the distance from the root end of the arm to the protrusion, the distance from the root end to the cam face or a part which contacts the cam face, the inclination of the cam face, etc.

In the electric connector with a locking mechanism according to the present invention, as its portion from the operating part to the protrusion is constituted with a plurality of members and the configuration, position, etc. of the cam face provided on one of these members can be altered, the amount of operation and the operation resistance of the operating part can be set freely according to the mode of use, and in turn, the electric connector with a locking mechanism can be used in a variety of modes of use.

PREFERRED EMBODIMENTS OF THE INVENTION

In the following, some embodiments of the present invention will be described. FIG. 1 through FIG. 5 show an electric connector with a locking mechanism 100 of the first embodiment. In this electric connector with a locking mechanism 100, female contacts are arranged sideways as well as vertically to form multiple layers or rows. The present invention, however, is applicable to an electric connector having male contacts. The number or arrangement of contacts of the electric connector with a locking mechanism according to the present invention is not limited in any way by this embodiment.

Figure 1:
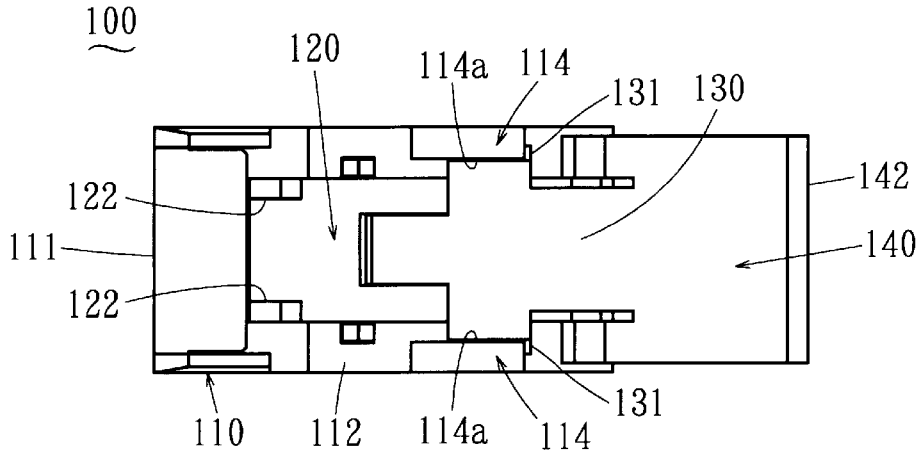
FIG. 1 is a plan view of the electric connector with a locking mechanism of the first embodiment.
Figure 2:
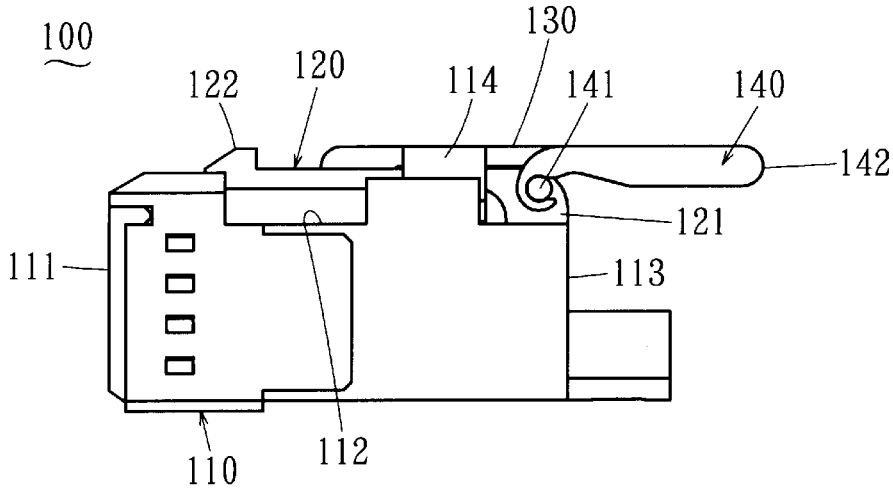
FIG. 2 is a side view of the above-mentioned electric connector with a locking mechanism.
Figure 3:
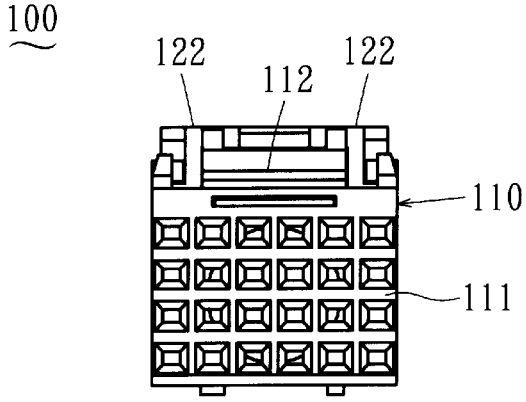
FIG. 3 is a front view of the above-mentioned electric connector with a locking mechanism.
Figure 4:
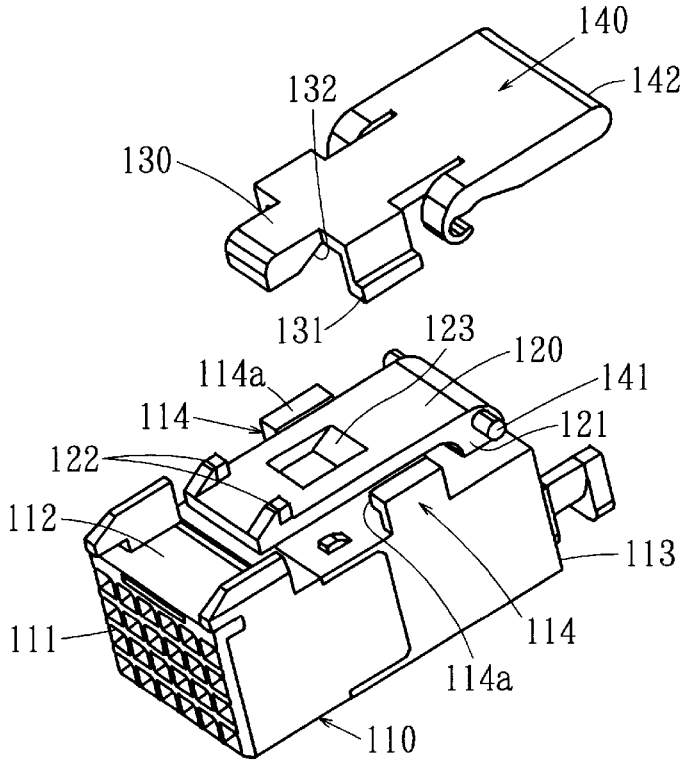
FIG. 4 is an exploded perspective view of the above-mentioned electric connector with a locking mechanism.
Figure 5:
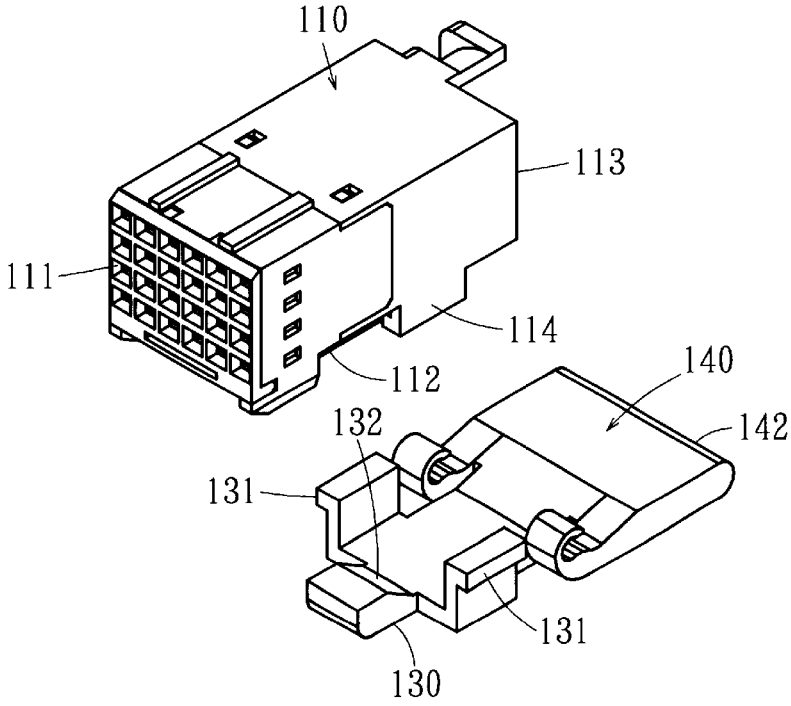
FIG. 5 is an exploded perspective view of the above-mentioned electric connector with a locking mechanism seen from a different angle.
Figure 6:
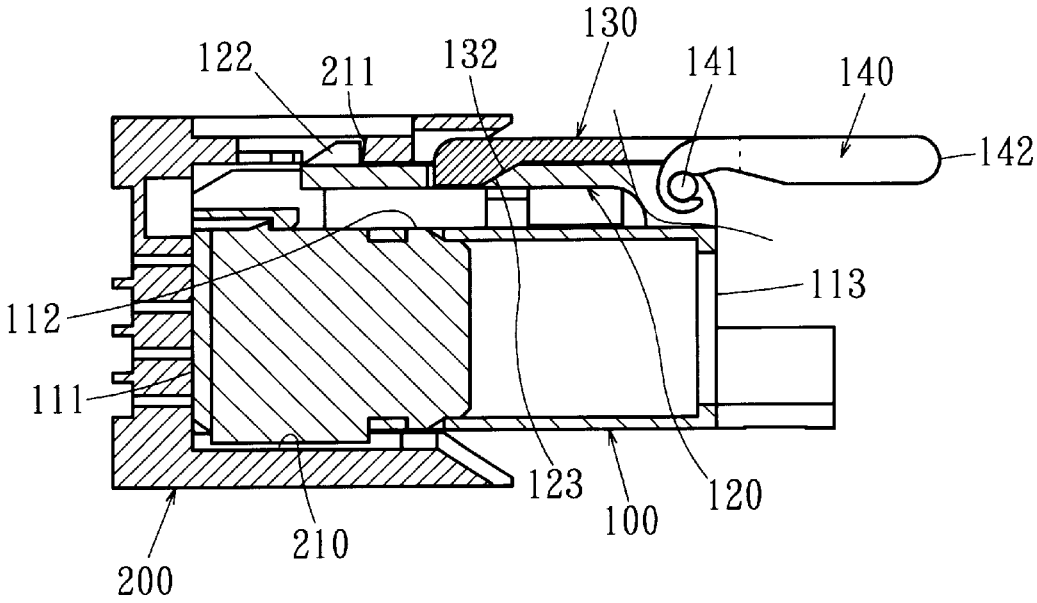
FIG. 6 is a sectional view of the body of the above-mentioned electric connector with a locking mechanism being inserted in the receiving recess of a counterpart electric connector.
Figure 7:
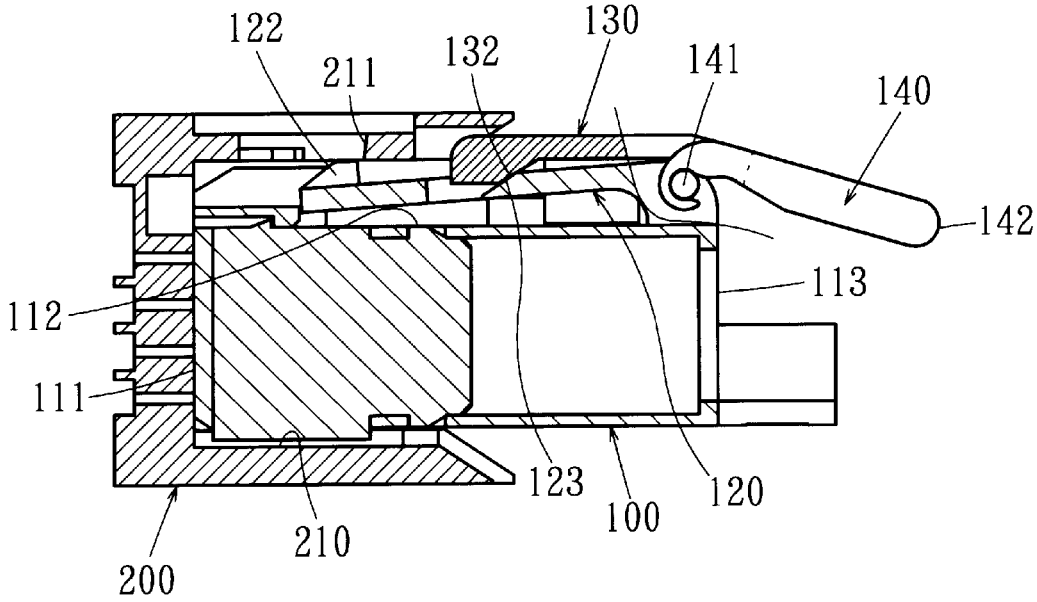
FIG. 7 is a sectional view of the body of the above-mentioned electric connector with a locking mechanism being withdrawn from the receiving recess of the counterpart electric connector.

As shown in FIG. 1 through FIG. 5, the above-mentioned electric connector with a locking mechanism 100 is provided with a body 110 which can be inserted into the receiving recess 210 of a counterpart electric connector 200. As shown in FIG. 6 and FIG. 7, the receiving recess 210 is concavely formed in the counterpart electric connector 200, and the above-mentioned body 110 is formed into a configuration which corresponds to the internal space of the receiving recess 210. The insertion of the body 110 of the electric connector with a locking mechanism 100 into the receiving recess 210 of the counterpart electric connector 200 connects the electric connector with a locking mechanism 100 with the counterpart electric connector 200, with each pair of corresponding contacts of the former and the latter contacting with each other. Conversely, the withdrawal of the body 110 of the electric connector with a locking mechanism 100 from the receiving recess 210 of the counterpart electric connector 200 disconnects the electric connector with a locking mechanism 100 from the counterpart electric connector 200, with each pair of the corresponding contacts being disconnected from each other. The direction of shifting of the body 110 or the receiving recess 210 at the time of insertion or withdrawal is defined as the direction of insertion and withdrawal, and is called the insertion/withdrawal direction for short. The body 110 is provided with cells of which number is equal to the number of poles, with each cell opening in the front wall 111 of the body 110 and holding a contact (not illustrated). Contacts to contact with those of the body 110 are provided deep in the receiving recess 210 of the counterpart electric connector 200 (not illustrated).

The above-mentioned body 110 is provided with a flexible arm 120. Its flexibility is accomplished by, for example, molding the arm 120 with a resin or the like. The arm 120 extends outside the body 110 in the insertion/withdrawal direction, with the root end 121 of the arm being provided on a side wall 112 of the body 110. The side wall 112 of the body 110 is a wall extending from the outer edge of the front wall 111 of the body 110 to the rear face 113 of the body 110 almost in the insertion/withdrawal direction. The root end 121 of the arm 120 may be provided integrally with the side wall 112 of the body 110 or fixed onto the side wall 112 by the fit-in method or any other method. The arm 120 is provided with protrusions 122, which rise in a direction of moving away from the side wall 112 and fit into fitting holes 211 of the receiving recess 210 of the counterpart electric connector 200. These protrusions 122 are provided closer to the top end of the arm 120 rather than to the root end 121 thereof. The fitting holes 211 of the counterpart electric connector 200 are provided in a wall which is one of the walls comprising the receiving recess 210 and faces the side wall 112 of the body 110 when the body 110 of the electric connector with a locking mechanism 100 is inserted in the receiving recess 210. Each fitting hole 211 may be a hole with a bottom or a through hole.

The above-mentioned body 110 is provided with a slider 130. The slider 130 is provided in such a way that it extends outside the body 110 in the insertion/withdrawal direction and at least a part thereof overlaps with the arm 120 in the direction of going away from the side wall 112 of the body 110. In this embodiment, the arm 120, rather than the slider 130, is arranged to be closer to the side wall 112, but their relationship may be reversed. The slider 130 is provided on the body 110 in such a way that it can slide in the insertion/withdraw direction. In this embodiment, both the body 110 and the slider 130 have planes which are almost parallel to the side wall 112 of the body 110, and the body 110 and the slider 130 can contact with and slide against each other by means of these planes, and the slider 130 is held to prevent it from coming off the body 110. In other words, in a plane which is substantially parallel to the side wall 112 of the body 110, a direction substantially perpendicular to the insertion/withdrawal direction is defined as the width direction, and support members 114 rise from the side wall 112 to face each other across the arm 120 in the width direction of the body 110. Each support member 114 is provided with a support piece 114*a* which is substantially parallel to the side wall 112 and extends in the insertion/withdrawal direction. On the other hand, the slider 130 is provided, on both edges thereof in the width direction, with supported pieces 131 protruding in the width direction. Each supported piece 131, rather than the support piece 114*a* of the corresponding support member 114, is located closer to the side wall 112. The outer face of the supported piece 131 being the far side thereof from the side wall 112 contacts with the inner face of the support piece 114*a* being the near side thereof to the side wall 112. The slider 130 can slide over the body 110 in the insertion/withdrawal direction through the sliding of the two faces.

The above-mentioned arm 120 or the above-mentioned body 110 is provided with an operating lever 140 in such a way that the operating lever 140 can rotate on an axis of rotation 141 extending in the width direction. Here, the axis of rotation 141 is provided at the root end 121 of the arm 120, and the operating lever 140 is provided with bearing members which rotatably fit on the axis of rotation 141 from outside. The axis of rotation may be provided on the body rather than the arm. The axis of rotation may be provided on the operating lever and the parts to fit on the axis of rotation may be provided on the arm or the body, respectively. The top end 142 of the operating lever 140 protrudes from the rear face of the body 110, and the operating lever 140 is coupled with the slider 130 so that when the operating lever 140 is rotated, the slider will be slid. Here, the axis of rotation 141 is closer to the side wall 112 than the coupling section between the operating lever 140 and the slider 130, and due to this offset, when the operating lever 140 is rotated, the slider 130 will be slid.

At least one of the arm 120 and the slider 130 is provided with a cam face which is inclined in such a way that its distance from the side wall 112 of the body 110 changes along the insertion/withdrawal direction, and flexes the arm 120 according to the sliding of the slider 130 so as to bring the protrusions 122 closer to the side wall 112 of the body 110. In this embodiment, cam faces are provided on both the arm 120 and the slider 130. The cam face 123 of the arm 120 is located closer to the side wall 112 of the body 110 than the cam face 132 of the slider 130, and these cam faces have a face-contact with each other. The cam faces 123 and 132 are inclined in such a way that their distances from the side wall 112 of the body 110 increase along the insertion/withdrawal direction from the front wall 111 of the body 110 toward the rear face 113 thereof. Accordingly, when the slider 130 slides in the insertion/withdrawal direction from the front wall 111 of the body 110 toward the rear face 113 thereof, the cam face 123 of the arm 120 will be pressed by the cam face 132 of the slider 130, and as the slider 130 does not move in the direction of going away from the side wall 112, the arm 120 will be flexed to get closer relatively toward the side wall 112. As a result, the protrusions 122 will get closer to the side wall 112 of the body 110.

In this embodiment, the operating lever 140 extends outside the body 110 almost in the insertion/withdrawal direction. The axis of rotation 141 is closer to the side wall 112 of the body 110 than the slider 130, and as shown in FIG. 7, the configuration is such that when the top end 142 is rotated towards the rear face 113 of the body 110, the slider 130 will be slid to bring the protrusions 122 closer to the side wall 112 of the body 110. The operating lever 140 and the slider 130 are coupled together by integrally molding them with a flexible material such as resin.

Accordingly, as shown in FIG. 6, when the body 110 of the electric connector with a locking mechanism 100 is inserted into the receiving recess 210 of the counterpart electric connector 200, the protrusions 122 will fit into the fitting holes 211 of the receiving recess 210 of the counterpart electric connector 200 due to the flexibility of the arm 120, and in turn, the electric connector with a locking mechanism 100 will be locked on to the counterpart electric connector 200. For withdrawing the electric connector with a locking mechanism 100 from the counterpart electric connector 200, as shown in FIG. 7, the operating lever 140 is rotated. Then the slider 130 will be slid, and due to the guiding functions of the cam faces 123 and 132, the arm 120 will be flexed to move the protrusions 122 closer to the side wall 112 of the body 110. As a result, the protrusions 122 will come out of the fitting holes 211 of the receiving recess 210 of the counterpart electric connector 200, allowing the withdrawal of the electric connector with a locking mechanism 100. In that case, the amount of operation and the operation resistance of the operating lever 140 can be freely set by changing, for example, the distance from the root end 121 of the arm 120 to the protrusions 122, the distance from the root end 121 to the cam face 123, or the inclinations of the cam faces 123 and 132.

The present invention includes embodiments wherein a cam face is provided on at least one of the arm and the slider. Accordingly, the present invention includes embodiments wherein a cam face is provided on either the arm or the slider, and the other one is provided with a part which contacts with the cam face and is guided by the cam face. In these embodiments, the amount of operation and the operation resistance of the operating lever can be freely set by changing the distance from the root end of the arm to the protrusions, the distance from the root end to the cam face or the part contacting with the cam face, the inclination of the cam face, etc. Among them, in the electric connector with a locking mechanism 100 of the above-mentioned embodiment, cam faces 123 and 132 are provided on both the arm 120 and the slider 130, and these cam faces are made to have a face-contact with each other. With this arrangement, as the cam face 123 of the arm 120 and the cam face 132 of the slider 130 have a face-contact with each other, the face pressures per unit area of these cam faces can be kept low, and in turn, the operation resistance of the operating lever 140 can be reduced.

The present invention includes all embodiments wherein the operating lever is rotatably provided on the body so that the top end of the operating lever protrudes from the rear face of the body and the operating lever is coupled with the slider so that when the operating lever is rotated, the slider will be slid. Among these embodiments, in the electric connector with a locking mechanism 100 of the above-mentioned embodiment, the configuration is such that the operating lever 140 extends outside the body 110 almost in the insertion/withdrawal direction, the axis of rotation 141 is located closer to the side wall 112 of the body 110 than the slider 130, and when the top end 142 is rotated towards the rear face 113 of the body 110, the slider 130 will be slid to bring the protrusions 122 closer to the side wall 112 of the body 110. With this arrangement, the operating lever 140 can be kept almost within the space directly behind the body 110 in the insertion/withdrawal direction. Hence the operating lever 140 can be operated even when there is no space around the body 110 except said space directly behind the body 110 in the insertion/withdrawal direction. This is convenient, for example, when the invention is used for an electric connector with a locking mechanism wherein contacts are arranged in multiple layers.

The present invention includes all embodiments wherein the operating lever and the slider are provided as separate members. Among them, in the electric connector with a locking mechanism 100 of the above-mentioned embodiment, the operating lever 140 and the slider 130 are coupled together by integrally molding them with a flexible material. With this arrangement, the number of parts is reduced and, in turn, the number of control processes is reduced, and the productivity is enhanced through integral molding.

Figure 8:
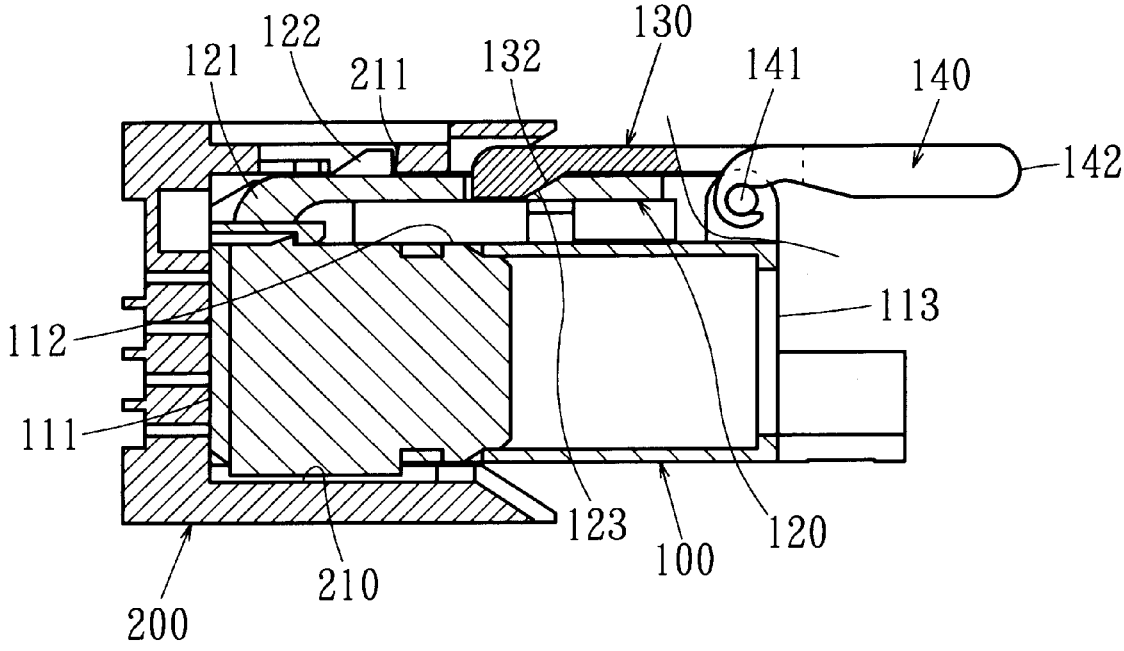
FIG. 8 is a sectional view of the body of the electric connector with a locking mechanism of the second embodiment being inserted in the receiving recess of a counterpart electric connector.

FIG. 8 shows the second embodiment. In the first embodiment, the root end 121 of the arm 120 is located on the arm 120 at a point close to the rear face 113 of the body 110. In contrast to this, in the second embodiment, the root end 121 of the arm 120 is located on the arm 120 at a point close to the front wall 111 of the body 110. Its operation and effects are similar to those of the first embodiment.

With the description of these embodiments, the first electric connector with a locking mechanism, which was described in Summary of the Invention, has been fully disclosed. Moreover, with the description of these embodiments, the second electric connector through the fourth electric connector, which will be described below, have been fully described.

The second electric connector with a locking mechanism is the first electric connector with a locking mechanism wherein cam faces are provided on both the arm and the slider and these cam faces are in face-contact with each other.

With this arrangement, as the arm and the slider make a face-contact with their cam faces, the face pressures per unit area of the cam faces are kept low, and the operation resistance of the operating lever can be reduced.

The third electric connector with a locking mechanism is the first electric connector with a locking mechanism or the second electric connector with a locking mechanism, wherein the configuration is such that the operating lever extends outside the body almost in the insertion/withdrawal direction, the axis of rotation is located closer to the side wall of the body than the slider, and when the top end is rotated towards the rear face of the body, the slider will be slid to bring the protrusion closer to the side wall of the body.

With this arrangement, the operating lever can be kept almost within the space directly behind the body in the insertion/withdrawal direction. Hence the operating lever can be operated even when there is no space around the body except said space directly behind the body in the insertion/withdrawal direction. This is convenient, for example, when the invention is used for an electric connector with a locking mechanism wherein contacts are arranged in multiple layers.

The fourth electric connector with a locking mechanism is any one of the first electric connector with a locking mechanism through the third electric connector with a locking mechanism, wherein the operating lever and the slider are coupled together by integrally molding them with a flexible material.

With this arrangement, the number of parts is reduced and, in turn, the number of control processes is reduced, and the productivity is enhanced through integral molding.

What is claimed is:

1. An electric connector with a locking mechanism comprising a body to be inserted into a receiving recess of a counterpart electric connector, a flexible arm, of which root end is provided on a side wall of the body, said flexible arm extending outside the body in the direction of insertion and withdrawal and being provided with a protrusion, which rises in a direction of going away from the side wall of the body and fits into a fitting hole of the receiving recess of the counterpart electric connector, a slider being provided in such a way that it extends outside the body in the direction of insertion and withdrawal, overlaps with the arm in the direction of going away from the side wall of the body and can slide over the body in the direction of insertion and withdrawal, and an operating lever being rotatably provided on the arm or the body in such a way that the top end thereof comes out on the rear face side of the body and being coupled with the slider in such a way that when the operating lever is rotated, the slider will be slid, at least either said arm or said slider being provided with a cam face which is inclined in such a way that its distance from the side wall of the body changes along the direction of insertion and withdrawal and makes the arm flex according to the sliding of the slider so that the protrusion come closer to the side wall of the body.

2. An electric connector with a locking mechanism as recited in claim 1, wherein the operating lever and the slider are coupled together by integrally molding them with a flexible material.

3. An electric connector with a locking mechanism as recited in claim 1, wherein the configuration is such that the operating lever extends outside the body almost in the insertion/withdrawal direction, the axis of rotation is located closer to the side wall of the body than the slider, and when the top end is rotated towards the rear face of the body, the slider will be slid to bring the protrusion closer to the side wall of the body.

4. An electric connector with a locking mechanism as recited in claim 3, wherein the operating lever and the slider are coupled together by integrally molding them with a flexible material.

5. An electric connector with a locking mechanism as recited in claim 1, wherein cam faces are provided on both the arm and the slider and these cam faces make a face-contact with each other.

6. An electric connector with a locking mechanism as recited in claim 5, wherein the operating lever and the slider are coupled together by integrally molding them with a flexible material.

7. An electric connector with a locking mechanism as recited in claim 5, wherein the configuration is such that the operating lever extends outside the body almost in the insertion/withdrawal direction, the axis of rotation is located closer to the side wall of the body than the slider, and when the top end is rotated towards the rear face of the body, the slider will be slid to bring the protrusion closer to the side wall of the body.

8. An electric connector with a locking mechanism as recited in claim 7, wherein the operating lever and the slider are coupled together by integrally molding them with a flexible material.

* * * * *